US006179685B1

(12) United States Patent
Toft

(10) Patent No.: US 6,179,685 B1
(45) Date of Patent: Jan. 30, 2001

(54) TOY

(75) Inventor: Hanne Toft, Egtved (DK)

(73) Assignee: INTERLEGO AG, Baar (CH)

( * ) Notice: Under 35 U.S.C. 154(b), the term of this patent shall be extended for 0 days.

(21) Appl. No.: 09/254,833

(22) PCT Filed: Sep. 16, 1997

(86) PCT No.: PCT/DK97/00386

§ 371 Date: May 20, 1999

§ 102(e) Date: May 20, 1999

(87) PCT Pub. No.: WO98/11967

PCT Pub. Date: Mar. 26, 1998

(30) Foreign Application Priority Data

Sep. 17, 1996 (DK) ..... 1006/96

(51) Int. Cl.[7] ..... A63H 3/50
(52) U.S. Cl. ..... 446/390; 446/128; 446/268
(58) Field of Search ..... 446/97, 98, 99, 446/100, 101, 118, 268, 390, 128

(56) References Cited

U.S. PATENT DOCUMENTS 2,336,467 * 12/1943 Cohen .
3,009,284 11/1961 Ryan .
3,234,689 2/1966 Ryan .
3,668,805 * 6/1972 Coleman .
4,063,381 12/1977 Deulofeu .
4,170,840 * 10/1979 Ogawa .
5,024,611 * 6/1991 Eckerle et al. .
5,378,187 * 1/1995 Forbes et al. .
5,725,411 * 3/1998 Glynn .

FOREIGN PATENT DOCUMENTS 632 934 A5 11/1982 (CH) .
197807 * 7/1978 (DE) ..... 446/97
940685 * 12/1948 (FR) ..... 446/99

* cited by examiner

*Primary Examiner*—Jacob K. Ackun
*Assistant Examiner*—Jeffrey D. Carlson
(74) *Attorney, Agent, or Firm*—Pitney, Hardin, Kipp & Szuch LLP

(57) ABSTRACT

A toy in the form of a shoe having a heel with a tread and a foresole with a substantially plane tread. The treads of the heel and the foresole being separated from each other. The toy additionally has a platform on which the shoe may be placed. The platform being shaped so that just the heel of the shoe forms a complementary coupling to allow the shoe to be detachably coupled to the platform.

10 Claims, 2 Drawing Sheets

TOY

BACKGROUND OF THE INVENTION

The present invention concerns a toy comprising a shoe having at least one heel with a tread and a foresole with a substantially plane tread, said treads of the heel and the foresole being separated from each other, said toy additionally comprising a platform on which the shoe may be placed, said platform being provided with coupling means, wherein just the heel of the shoe forms a complementary coupling means to allow the shoe to be detachably coupled to the platform.

Such a toy is known from U.S. Pat. No. 3 234 689, which discloses a doll with associated shoes. The doll is shaped as a a human being, and the legs are formed with substantially rigid ankle joints. For the doll to stand independently, the toy comprises a platform provided with holes in which the shoes of the doll may be mounted in that these shoes are provided with an extended heel which can be inserted into the holes in the platform.

SUMMARY OF THE INVENTION

As the doll is attached stably to the platform by means of the shoes, and as the extended heel is rotatable in the holes in the platform, the doll can hereby assume various positions with respect to the platform, although the ankles of the doll are rigid. If, on the other hand, it is desired to place the doll on a plane face, this can just be done if the shoes of the doll are exchanged.

From CH-A-632 934 is known a figure being shaped as a human being, and wherein the ankles are rigid. A platform having coupling studs is provided for mounting the figure on the platform, as the figure has recesses below the feet, the recesses being shaped so as to be pressed frictionally down over the coupling studs on the platform.

Known are also toys comprising dolls with articulated ankles on which shoes are mounted, said shoes having recesses below the heel and the foresole which may be pressed frictionally down over coupling studs on an associated platform, said coupling studs being arranged in a square pattern defining two mutually perpendicular module directions and with the same mutual module distance between adjacent coupling studs.

A doll of the last-mentioned type can hereby be placed on plane platform as well as on a platform provided with coupling studs, which makes the doll superior to the first-mentioned doll with associated shoes. For the last-mentioned doll to assume many different positions, the ankles must be articulated, and when the doll is mounted on a platform having coupling studs, the shoes must be oriented in one of the two perpendicular module directions, so that the positions which the doll can assume are not quite natural.

The object of the present invention is to disclose a toy of the type mentioned in the opening paragraph, which allows a doll to assume many different natural positions on a platform having coupling means for the mounting of a shoe, while allowing the doll with shoes to be placed on a plane platform without coupling studs.

This object is achieved by a toy as defined in claim 1 in that the toy mentioned in the opening paragraph is unique in that the coupling means on the platform are formed by a plurality of coupling parts protruding with respect to the platform, and in that the tread on the heel of the shoe extends in a plane which coincides with the tread on the foresole of the shoe.

The treads on the heel and foresole of the shoe hereby form a stable engagement face to support the shoe and thereby the doll provided with shoes on a plane surface.

Although the shoe, when mounted on the platform provided with protruding coupling parts, is positioned a little askew, this skewness is very small because of the shape of the heel, and the shoe with the mounted doll is nevertheless secured stably owing to the frictional connection between the relatively wide heel and the protruding coupling parts on the platform.

Additionally stability is obtained in that the heel of the shoe is formed with a width which is greater than its height. In preferred embodiments of the toy, the tread of the heel on the shoe is formed substantially rotationally symmetrical, and the heel substantially has an outer cylindrical shape, and the protruding coupling parts of the platform have a mutual distance which allows the heel of the shoe to be pressed frictionally down between the protruding coupling parts on the platform, it being particularly expedient that the tread of the heel is formed substantially as a circle, and that the heel substantially forms a cylindrical tube, and that at least some of the protruding coupling parts of the platform are formed as studs having an outer dimension which allows these studs to be pressed frictionally into the heel. It is hereby ensured, owing to the symmetry, that the shoe and thus the doll can rotate about the heel, and that doll can hereby assume many more natural positions.

The shoe may either be an integral part of the legs of a doll, or may be a separate part. In the last-mentioned case, the shoe must be provided with coupling means to receive a leg or a foot of the doll. Particularly in connection with shoes adapted to receive a naturally shaped foot on a doll, the present invention provides advantages, it being possible to construct the shoe with a front part to receive the forefoot of the doll, which part of the shoe may have a low profile. This would not be possible if also the foresole was provided with coupling means.

In this connection the shoe may expediently be made of a flexible plastics material, which makes it easy to achieve a suitable coupling friction between the foot of the doll and the shoe as well as between the shoe and the protruding coupling parts on the platform.

In a preferred embodiment, the protruding coupling parts on the platform and the shoe are mutually dimensioned such that, no matter how the heel is frictionally connected with the coupling parts on the platform, at least a portion of the foresole of the shoe will engage a protruding coupling part on the platform on the upper side of the coupling part. This provides increased stability.

Additional stability may be achieved by an embodiment wherein at least some of the coupling parts on the platform together form a circular groove between them, and wherein the heel of the shoe and the circular groove are mutually dimensioned such that the heel of the shoe may be pressed frictionally into the circular groove.

In a particularly preferred embodiment, the invention is characterized in that the protruding coupling parts on the platform comprise a first type of coupling parts which are formed as cylindrical studs, and a second type of coupling parts which each enclose the first type of coupling parts and thereby form the circular groove, said first and second types of coupling parts forming a coupling unit, said coupling parts on the platform being formed by such coupling units, which are mutually arranged on the platform in such a manner that they form a pattern with the same mutual module distance between adjacent coupling units. Precisely this structure involves a very high stability in the coupling between the shoe and the platform, no matter which orientation the shoe has with respect to the platform, as, generally speaking, the foresole on the shoe will always be supported by a coupling part of the second type, which is very wide because of the structure.

BRIEF DESCRIPTION OF THE DRAWINGS

The invention will now be described in a preferred embodiment and with reference to the drawing, in which.

DETAILED DESCRIPTION OF THE PREFERRED EMBODIMENT

Figure 1:
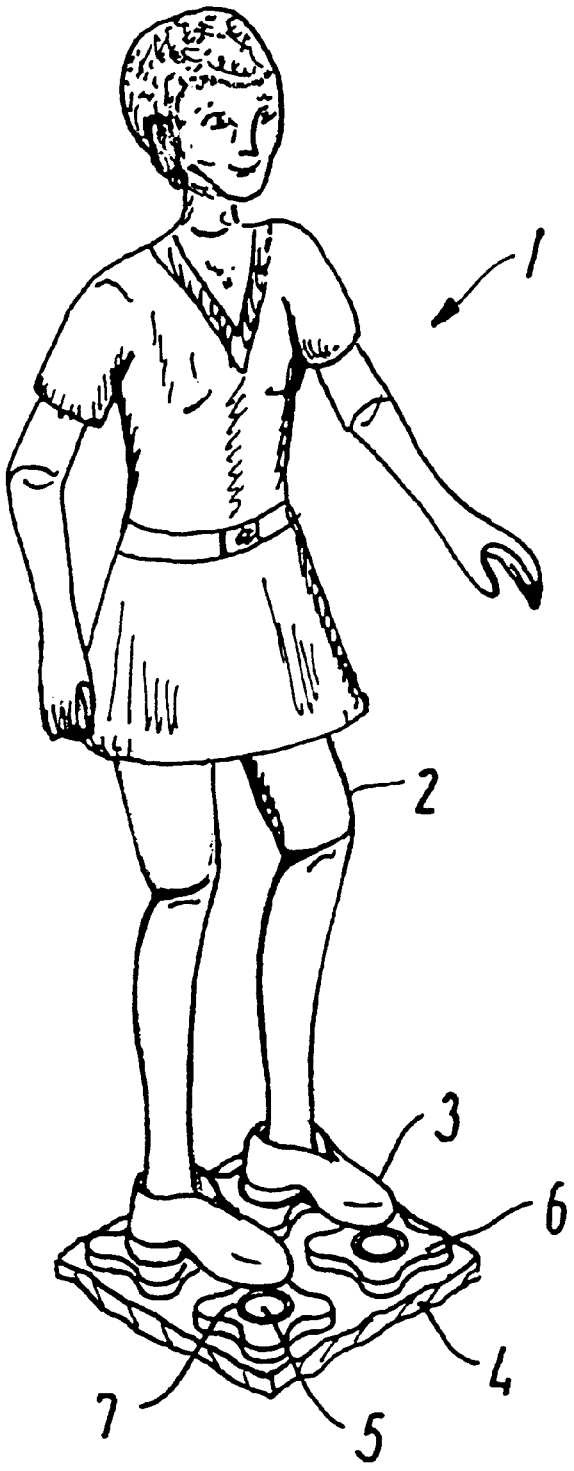
FIG. 1 is a perspective view of a doll having shoes according to the present invention, placed on a platform.

FIG. 1 shows a doll 1 having legs 2 and a pair of shoes 3 according to the present invention, said shoes being placed on a platform 4 which is provided with protruding coupling parts.

The coupling parts consist of a first type which are formed as a cylindrical stud 5, and of a second type which are formed as a coupling ring 6 which encloses the cylindrical stud 5 and thereby forms a circular groove 7.

The various possibilities of coupling the shoes 3 on the platform 4 are explained more fully below with reference to FIG. 4.

Figure 2:
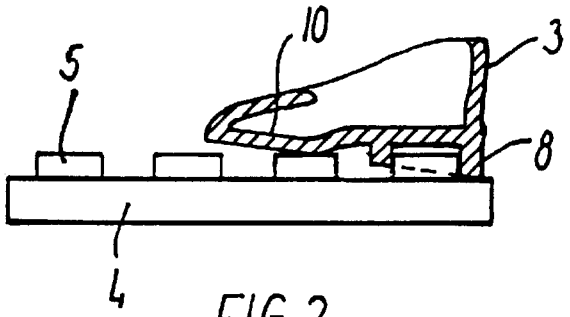
FIG. 2 is a sectional view showing a shoe mounted on a platform having coupling studs according to the invention.
Figure 4:
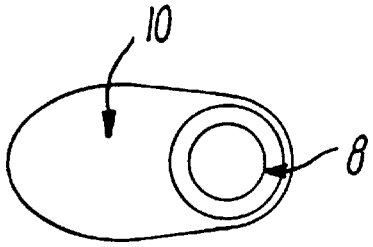
FIG. 4 is a bottom view of a shoe according to the invention.

FIG. 2 is a sectional view of a shoe 3 mounted on a platform 4*a* according to the invention, said shoe 3, as shown in particular in FIG. 4, having a heel 8 shaped as a circle and a foresole 10. As will be seen, the heel 8 may be pressed frictionally down over a cylindrical coupling stud 5, so that the foresole 10 of the shoe 3 rests on a second coupling stud 5. As will be seen, the foresole will thus not flatly engage the coupling stud, but because of the small impression required to achieve the frictional connection, this skewness will be small, and in this situation the actual coupling connection will be essential to maintain the shoe, and a possible doll with this shoe, in position.

Figure 3:
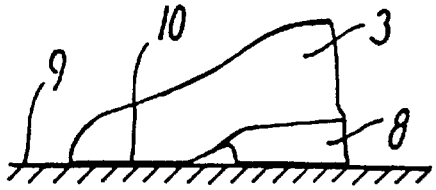
FIG. 3 is a lateral view of a shoe according to the invention placed on a plane platform.

FIG. 3, on the other hand, shows a situation where the shoe 3 rests on a totally plane platform 9, and it will be seen that according to the invention the shoe 3 flatly engages the platform 9 both with the foresole 10 and the heel 8, which, according to the invention, has a lower tread which is level with the foresole 10.

This provides a stable support for the shoe 3 both in the situation where the shoe 3 is coupled on a platform 4, 4*a* having studs 5, 6, and in the situation where the shoe 3 just rests on a plane platform 9.

Figure 5:
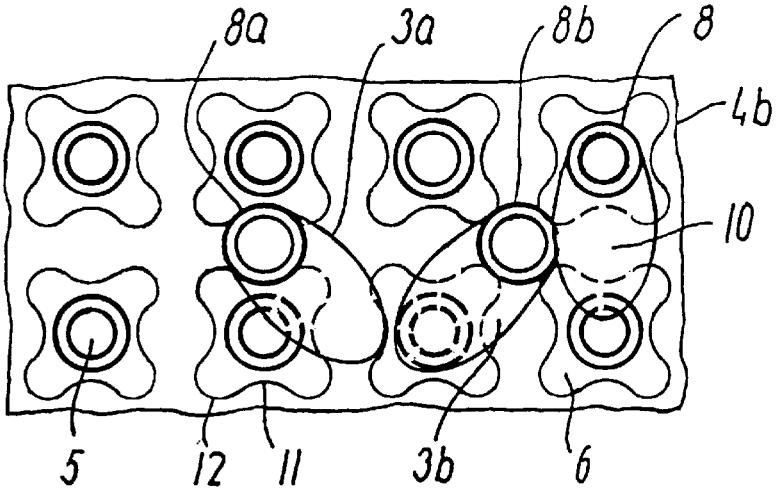
FIG. 5 is an explanatory sketch showing alternative coupling possibilities between a shoe and a platform according to the invention.

Finally, FIG. 5 shows a preferred embodiment of the present invention in which the protruding coupling parts 5, 6 on a platform 4*a* are formed by the said cylindrical coupling studs 5 and coupling rings 6 which enclose the coupling studs 5 radially. This results in the said circular groove 7 which may used for impression of the circular heel 8 on the shoe 3.

As will be seen, each coupling stud 5 and the surrounding coupling ring 6 constitutes a coupling unit, and the protruding coupling parts on the platform 4*a* are formed by a plurality of such coupling units 5, 6 which are arranged in a square pattern with mutually perpendicular module directions defined by the square pattern and the same mutual distance along the module directions between adjacent coupling units 5, 6.

As shown, the coupling rings have an outer contour which is alternately convex and concave, so that each coupling ring 6 has four convex 12 and four concave 11 portions. When the concave portions 11 on adjacent coupling rings 6 face each other, the coupling rings may be dimensioned so as to leave room for insertion of the heel 8*a* on a shoe 3*a* between two adjacent coupling rings 6.

When the concave portions on two adjacent coupling rings face each other in a diagonal direction with respect to the module directions, the coupling rings may be dimensioned such that a heel 8*b* may be inserted frictionally between four coupling rings 6.

A shoe 3, 3*a*, 3*b* may hereby be placed in many different ways, and as will be seen from FIG. 5, the foresole 10 will be completely supported irrespective of the orientation of the shoe, which is achieved essentially in that the coupling rings 6 have a considerably larger transverse dimension than the cylindrical coupling studs 5.

Clearly, the shown embodiment of the invention may be varied without departing from the basic idea of the invention. Thus, the protruding coupling parts on the platform may have shapes which vary from the one shown.

What is claimed is:

1. A toy comprising a shoe having a heel with a tread and a foresole with a substantially plane tread, said trends of the heel and the foresole being separated from each other, said toy additionally comprising a platform on which the shoe may be placed, said platform being provided with coupling means, wherein just the heel of the shoe forms a complementary coupling means to allow the heel of the shoe to be detachably coupled to the platform, wherein the coupling means on the platform are formed by a plurality of coupling parts protruding with respect to the platform, and in that the tread on the heel of the shoe extends in a plane which coincides with the tread on the foresole of the shoe, the tread of the heel is formed substantially rotationally symmetrical and substantially has an outer cylindrical shape, and the protruding coupling parts of the platform have a mutual distance which allows the heel of the shoe to be pressed frictionally down between the protruding coupling parts on the platform.

2. A toy according to claim 1, wherein the heel of the shoe is formed with a width which is greater than its height.

3. A toy according to claim 1, wherein the tread of the heel is formed substantially as a circle, and that the heel substantially forms a cylindrical tube, and that at least some of the protruding coupling parts of the platform are formed as studs having an outer dimension which allows these studs to be pressed frictionally into the heel.

4. A toy according to claim 1, wherein the shoe has a mounting means for the mounting of a leg or foot of a doll.

5. A toy according to claim 4, wherein the mounting means of the shoe are formed by a cavity to receive a naturally foot-shaped part of a doll.

6. A toy according to claim 5, wherein the shoe is made of a flexible plastics material.

7. A toy according to claim 1, wherein the shoe is formed as an integral part of a doll.

8. A toy according to claim 3, wherein the protruding coupling parts on the platform and the shoe are mutually dimensioned such that, no matter how the heel is frictionally connected with the coupling parts on the platform, at least a portion of the foresole of the shoe will contact a protruding coupling part on the platform on the upper side of the coupling part.

9. A toy according to claim 3, wherein at least some of the coupling parts on the platform together form a circular groove between them, and that the heel of the shoe and the circular groove are mutually dimensioned such that the heel of the shoe may be pressed frictionally into the circular groove.

10. A toy according to claim 9, wherein the protruding coupling parts on the platform comprise a first type of coupling parts which are formed as cylindrical studs, and a second type of coupling parts which each enclose the first type of coupling parts and thereby form the circular groove, said first and second types of coupling parts forming a coupling unit, said coupling parts on the platform being formed by such coupling units, which are mutually arranged on the platform in such a manner that they form a pattern with the same mutual module distance between adjacent coupling units.

* * * * *